US011479273B2

(12) United States Patent
Hattori et al.

(10) Patent No.: US 11,479,273 B2
(45) Date of Patent: Oct. 25, 2022

(54) HANDHOLD DEVICE OF RAILCAR

(71) Applicant: KAWASAKI RAILCAR MANUFACTURING CO., LTD., Kobe (JP)

(72) Inventors: Miwa Hattori, Kobe (JP); Takahiro Kawashima, Nishinomiya (JP); Yu Yamamoto, Amagasaki (JP)

(73) Assignee: KAWASAKI RAILCAR MANUFACTURING CO., LTD., Kobe (JP)

( * ) Notice: Subject to any disclaimer, the term of this patent is extended or adjusted under 35 U.S.C. 154(b) by 402 days.

(21) Appl. No.: 16/858,720

(22) Filed: Apr. 27, 2020

(65) Prior Publication Data

US 2021/0331719 A1 Oct. 28, 2021

(51) Int. Cl.
*B61D 49/00* (2006.01)
*B61D 23/00* (2006.01)

(52) U.S. Cl.
CPC ..... *B61D 49/00* (2013.01); *B61D 23/00* (2013.01)

(58) Field of Classification Search
CPC ..... B61D 49/00; B61D 23/00; B60R 3/02; B60R 3/007; A61G 7/0507
See application file for complete search history.

(56) References Cited

U.S. PATENT DOCUMENTS 5,046,582 A * 9/1991 Albrecht ..... B60R 3/02 182/127
5,711,555 A * 1/1998 Leedy ..... E05C 19/184 292/205
6,102,648 A * 8/2000 Fretwell ..... A61G 3/067 414/556
6,974,134 B1 * 12/2005 Macri ..... E05B 1/0015 16/412
7,744,141 B2 * 6/2010 Saionji ..... B60N 3/023 49/461
10,946,780 B2 * 3/2021 Bacon ..... E05B 1/0015
2020/0069122 A1 * 3/2020 Edwards ..... A47K 17/022

FOREIGN PATENT DOCUMENTS

JP 2019-151275 A 9/2019

* cited by examiner

*Primary Examiner* — Mark T Le
(74) *Attorney, Agent, or Firm* — Xsensus LLP

(57) ABSTRACT

A handhold device of a railcar includes: a frame arranged along a side edge of a specific door opening and connected to a car interior side of a side carshell; a turning mechanism provided at the frame and configured to be turnable about a turning axis extending in an upper-lower direction; and a handle including a base portion connected to the frame through the turning mechanism and a holding portion projecting from the base portion in a direction intersecting with the turning axis. The handle is angularly displaceable about the turning axis between a deployed position where the holding portion is exposed to the specific door opening when viewed from a lateral side of the car body and a storage position where the holding portion is hidden by the side carshell when viewed from the lateral side of the car body.

20 Claims, 10 Drawing Sheets

HANDHOLD DEVICE OF RAILCAR

TECHNICAL FIELD

The present disclosure relates to a handhold device corresponding to a specific door opening located above an exterior side step projecting downward from a side carshell of a car body of a railcar among a plurality of door openings of the side carshell, the handhold device being arranged in the railcar and attached to the side carshell.

BACKGROUND ART

In some cases, at the time of maintenance of a railcar, a worker gets into the railcar from the ground, performs work, and gets out from the railcar to the ground after the work. Therefore, in the vicinity of a specific door opening that is one of a plurality of door openings of a side carshell of a car body of the railcar, a device by which the worker can easily get in or out of the railcar through the specific door opening is preferred. Generally, a step on which the worker places his/her feet and a handle held by the worker with his/her hands are arranged in the vicinity of the specific door opening. The step is located under the specific door opening and fixed to the side carshell so as to project downward from the side carshell. The handle is fixed to the side carshell along a side edge of the specific door opening.

The handle may be arranged inside or outside the railcar. When the handle is arranged outside the railcar, ordinary people outside the railcar can access the handle during normal operation of the railcar. Therefore, the handle may be arranged inside the railcar so as not to be exposed to an outside of the railcar during the normal operation of the railcar. However, the handle is should be located at such a position that the worker on the ground can easily hold the handle with his/her hands. Therefore, when viewed from a lateral side of the car body, the handle needs to be exposed to the specific door opening. In this case, the handle may interfere with passengers who get in or out of the railcar through the specific door opening.

SUMMARY

A handhold device of a railcar according to one aspect of the present disclosure is a handhold device corresponding to a specific door opening located above an exterior side step projecting downward from a side carshell of a car body of the railcar among a plurality of door openings of the side carshell, the handhold device being arranged in the railcar and attached to the side carshell. The handhold device includes: a frame arranged along a side edge of the specific door opening and connected to a car interior side of the side carshell; a turning mechanism provided at the frame and configured to be turnable about a turning axis extending in an upper-lower direction; and a handle including a base portion connected to the frame through the turning mechanism and a holding portion projecting from the base portion in a direction intersecting with the turning axis. The handle is angularly displaceable about the turning axis between a deployed position where the holding portion is exposed to the specific door opening when viewed from a lateral side of the car body and a storage position where the holding portion is hidden by the side carshell when viewed from the lateral side of the car body.

According to the above configuration, the handle is angularly displaced to the deployed position at the time of maintenance. With this, a worker standing on the ground can easily hold the holding portion of the handle with his/her hands and can stably go up or down the exterior side step. After the maintenance is completed, the handle is angularly displaced to the storage position. With this, the handle can be prevented from interfering with passengers who get in or out of the railcar through the specific door opening.

DESCRIPTION OF EMBODIMENTS

Figure 1:
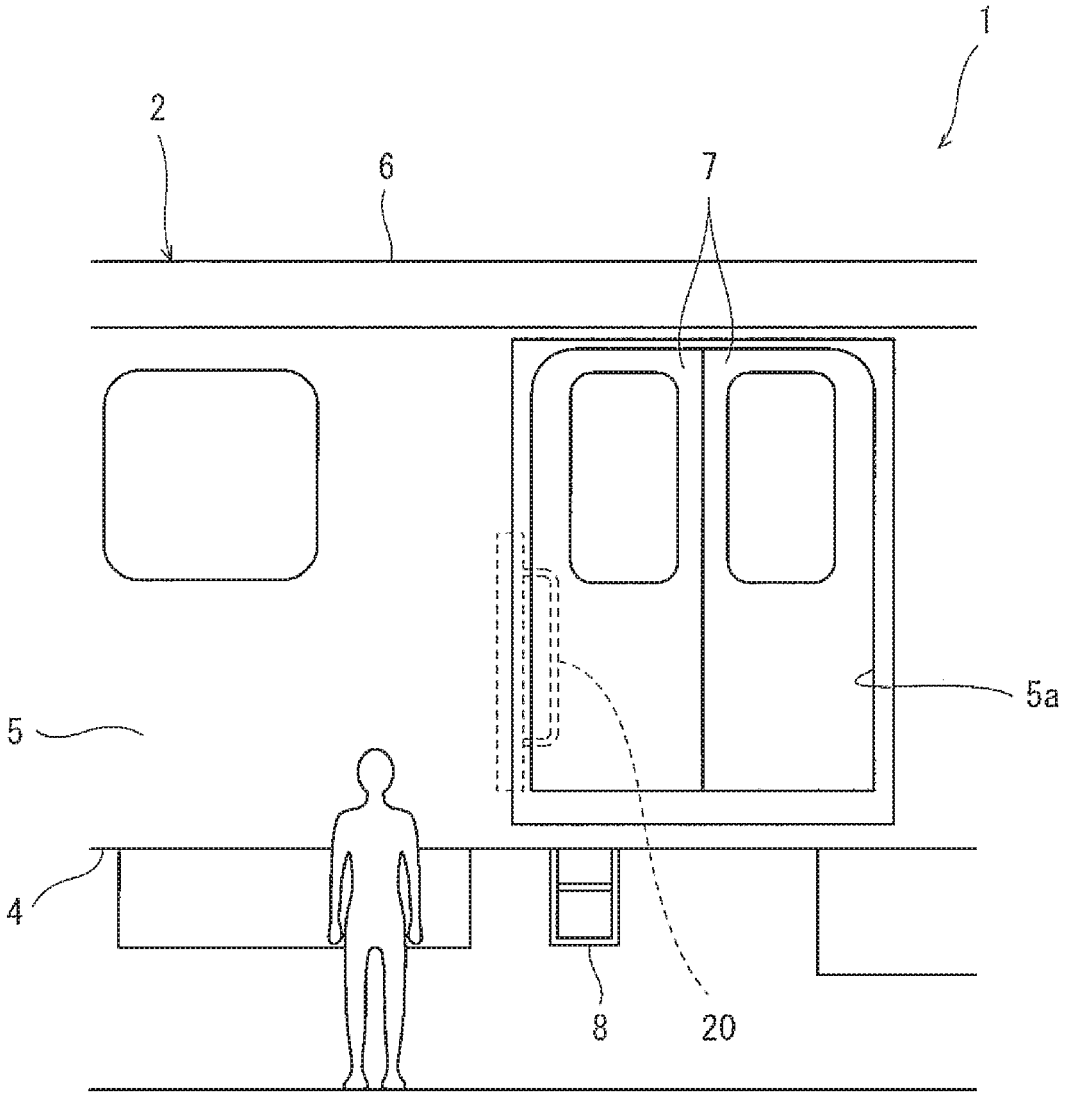
FIG. 1 is a side view of a railcar according to an embodiment when viewed from a car width direction.
Figure 2:
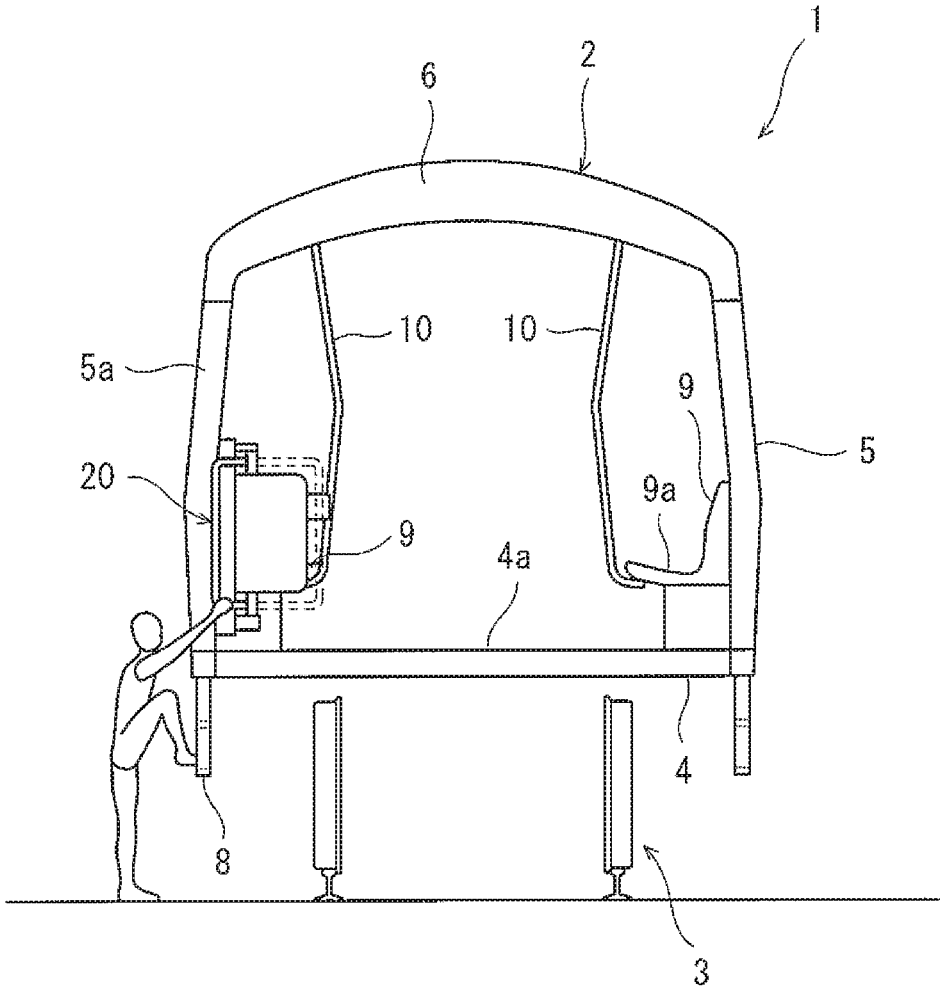
FIG. 2 is a sectional view of the railcar of FIG. 1 when viewed from a car longitudinal direction.

Hereinafter, an embodiment will be described with reference to the drawings. In the following description, a direction in which a railcar 1 travels is defined as a car longitudinal direction (front-rear direction), and a lateral direction perpendicular to the car longitudinal direction is defined as a car width direction (left-right direction). FIG. 1 is a side view of the railcar 1 according to the embodiment when viewed from the car width direction. FIG. 2 is a sectional view of the railcar 1 of FIG. 1 when viewed from the car longitudinal direction. As shown in FIGS. 1 and 2, the railcar 1 includes a car body 2 and a bogie 3 supporting the car body 2. The car body 2 includes a floor carshell 4, a pair of side carshells 5, and a roof carshell 6. The pair of side carshells 5 project upward from both car width direction ends of the floor carshell 4. The roof carshell 6 is connected to upper ends of the pair of side carshells 5.

The side carshell 5 includes a plurality of door openings 5*a* (only one door opening 5*a* is shown in FIG. 1). Side sliding doors 7 configured to be opened or closed by sliding are provided at the door opening 5*a*. When viewed from a lateral side of the car body 2 (i.e., when viewed from the car width direction), an exterior side step 8 projecting downward from a lower end of the side carshell 5 is provided right under a predetermined door opening 5*a* that is one of the plurality of door openings 5*a*. Specifically, when viewed from the lateral side of the car body 2, the exterior side step 8 is arranged right under the door opening 5*a* so as to be located closer to one of side edges of the door opening 5*a* than the other side edge of the door opening 5*a*.

A passenger seat 9 is arranged inside the car body 2 so as to be located close to the door opening 5*a*. The passenger seat 9 is, for example, a long seat extending along the side carshell 5 in the car longitudinal direction but may be a different type of seat. Handrail rods 10 extending in a substantially upper-lower direction are arranged at both sides of the passenger seat 9 in an extending direction (car longitudinal direction) of the passenger seat 9. For example, lower ends of the handrail rods 10 are connected to the side carshell 5, and upper ends of the handrail rods 10 are connected to the roof carshell 6.

The exterior side step 8 is provided so as to correspond to only the predetermined door opening 5*a* among the plurality of door openings 5*a*, and there are no exterior side steps corresponding to the other door openings 5*a*. The door opening 5*a* located right above the exterior side step 8 is hereinafter referred to as a specific door opening 5*a*. A handhold device 20 is arranged close to the specific door opening 5*a*. The handhold device 20 is arranged inside the car body 2 and fixed to the side carshell 5. The handhold device 20 is a device which is held by a worker with his/her hands when the worker gets in the railcar 1 from the ground through the specific door opening 5*a* or when the worker gets out of the railcar 1 to the ground through the specific door opening 5*a*, i.e., a device by which the worker can easily get in or out of the railcar 1.

Figure 3:
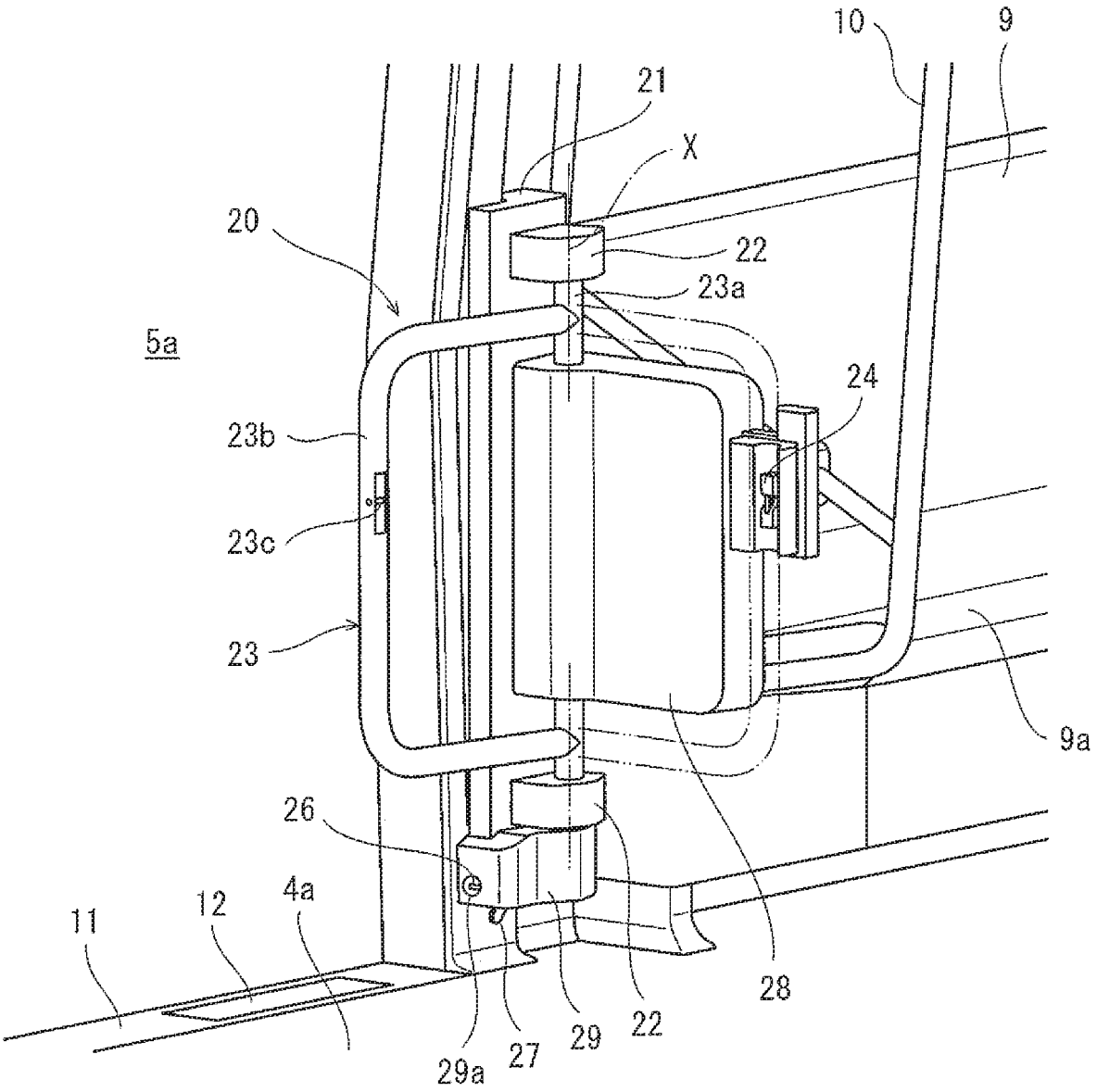
FIG. 3 is a perspective view of a handhold device of the railcar of FIG. 1 and its vicinity when viewed from a car interior side.
Figure 4:
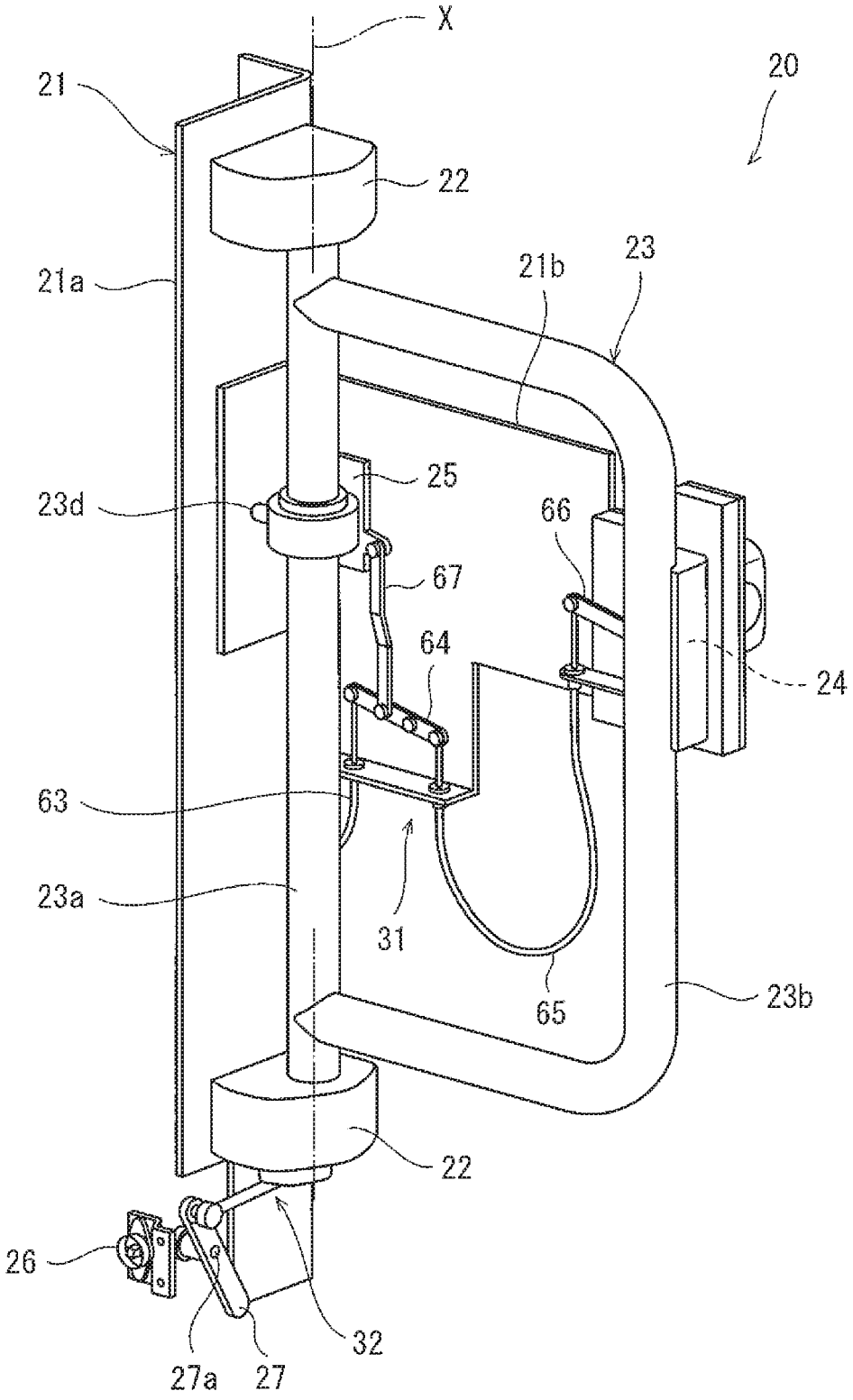
FIG. 4 is a perspective view showing that a cover of the handhold device of FIG. 3 is detached, and a handle is located at a storage position.
Figure 5:
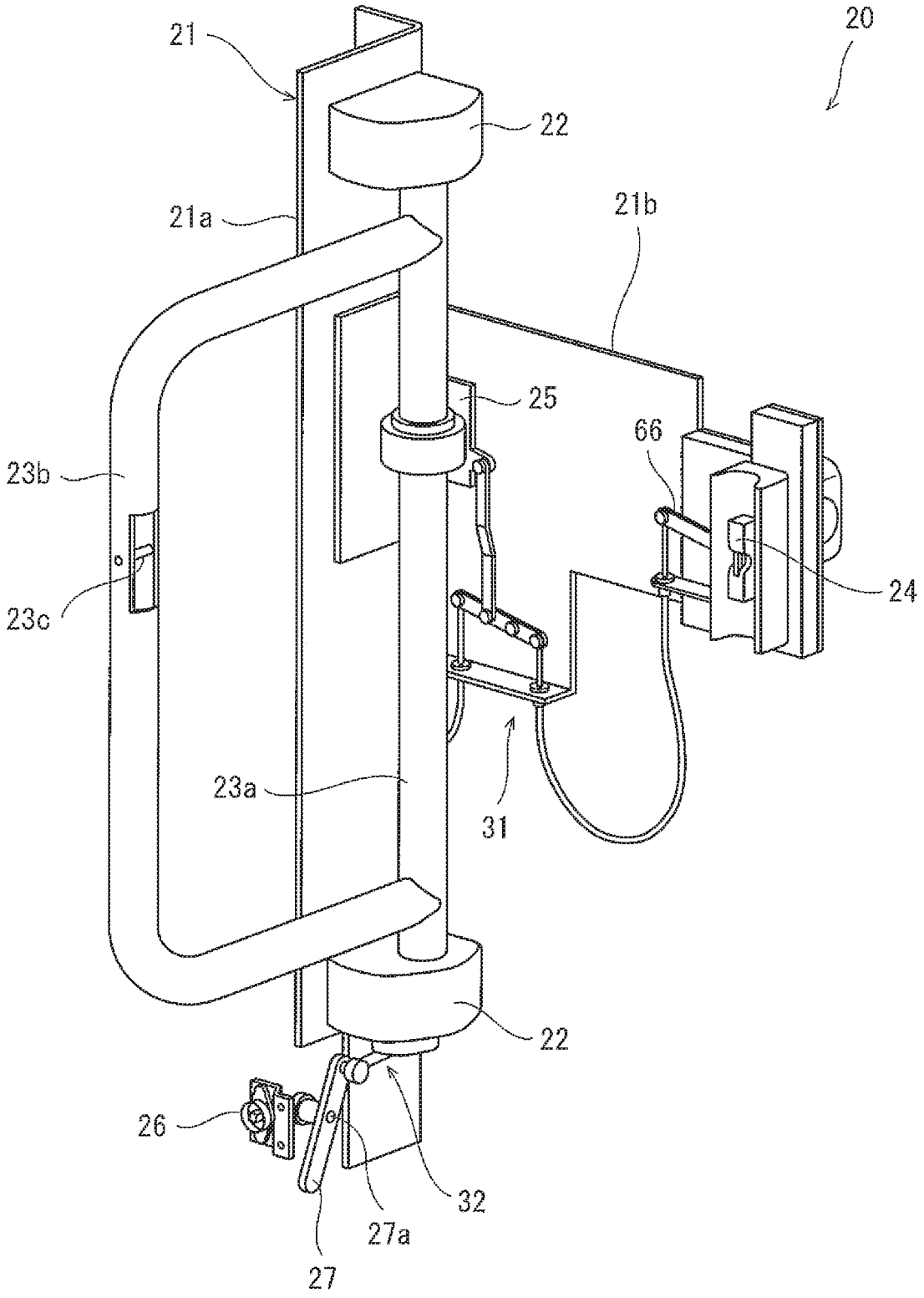
FIG. 5 is a perspective view showing that the handle of the handhold device of FIG. 4 is located at a deployed position.

FIG. 3 is a perspective view of the handhold device 20 of the railcar 1 of FIG. 1 and its vicinity when viewed from a car interior side. FIG. 4 is a perspective view showing that a middle cover 28 and lower cover 29 of the handhold device 20 of FIG. 3 are detached, and a handle 23 is located at a storage position. FIG. 5 is a perspective view showing that the handle 23 of the handhold device 20 of FIG. 4 is located at a deployed position. As shown in FIG. 3, the handhold device 20 is arranged in the railcar 1 along the side edge of the specific door opening 5*a*. To be specific, the handhold device 20 is arranged in a door niche between the specific door opening 5*a* and the passenger seat 9. The handhold device 20 includes a frame 21, a pair of turning mechanisms 22, the handle 23, a storage lock mechanism 24, a deployment lock mechanism 25, a lock operating unit 26, an assist lever unit 27, the middle cover 28, and the lower cover 29.

As shown in FIGS. 3 and 4, the frame 21 is arranged along the side edge of the specific door opening 5*a* and fixed to the side carshell 5. The pair of turning mechanisms 22 are arranged away from each other in the upper-lower direction. The pair of turning mechanisms 22 are respectively connected to an upper portion and lower portion of the frame 21. The turning mechanisms 22 are turnable about a turning axis X extending in the upper-lower direction. The handle 23 is formed by, for example, a round pipe. The handle 23 includes a base portion 23*a* and a holding portion 23*b*. The base portion 23*a* is connected to the frame 21 through the turning mechanisms 22. The holding portion 23*b* projects from the base portion 23*a* in a direction perpendicular to the turning axis X. Specifically, the base portion 23*a* is a shaft portion extending between the pair of turning mechanisms 22 in the upper-lower direction. The holding portion 23*b* projects from the base portion 23*a* so as to form a U shape.

The handle 23 can turn about the turning axis X by the turning mechanisms 22, i.e., is angularly displaceable. The handle 23 is angularly displaceable about the turning axis X between the deployed position (shown by solid lines in FIG. 3) and the storage position (shown by two-dot chain lines in FIG. 3). In a case where the handle 23 is located at the deployed position, the holding portion 23*b* is exposed to the specific door opening 5*a* when viewed from the lateral side of the car body 2. In a case where the handle 23 is located at the storage position, the holding portion 23*b* is hidden by the side carshell 5, i.e., is not exposed to the specific door opening 5*a* when viewed from the lateral side of the car body 2. An engaged portion 23*c* (engaged bar, for example) for storage is provided at the holding portion 23*b* of the handle 23. An engaged portion 23*d* (engaged bar, for example) for deployment is provided at the base portion 23*a* of the handle 23.

The storage lock mechanism 24 is one example of a storage positioner configured to position the handle 23 at the storage position. When the handle 23 is displaced to the storage position, the storage lock mechanism 24 is engaged with the engaged portion 23*c* of the handle 23 to hold and lock the handle 23 at the storage position. The deployment lock mechanism 25 is one example of a deployment positioner configured to position the handle 23 at the deployed position. When the handle 23 is displaced to the deployed position, the deployment lock mechanism 25 is engaged with the engaged portion 23*d* of the handle 23 to hold and lock the handle 23 at the deployed position. The storage lock mechanism 24 and the deployment lock mechanism 25 are independent from each other.

The lock operating unit 26 is operated by the worker. When the worker unlocks the lock operating unit 26, the storage lock mechanism 24 and the deployment lock mechanism 25 are switched from a locked state to an unlocked state in conjunction with the unlocking of the lock operating unit 26. The lock operating unit 26 is configured to be operable by means of a specific key therein. The assist lever unit 27 is operated by the worker. When the worker pulls the assist lever unit 27, the handle 23 is angularly displaced from the storage position to the deployed position in conjunction with the pulling of the assist lever unit 27.

The lock operating unit 26 and the assist lever unit 27 are arranged at positions that are higher than a floor surface 4*a* of the car body 2 and lower than a seat surface 9*a* of the passenger seat 9. Specifically, the lock operating unit 26 and the assist lever unit 27 are arranged in a height range of 0 to 30 cm, for example, from the floor surface 4*a* of the car body 2. In the direction perpendicular to the turning axis X, the lock operating unit 26 and the assist lever unit 27 are arranged at positions between the turning axis X and a part of the holding portion 23*b* of the handle 23 located at the deployed position, the part being located farthest from the base portion 23*a*. When viewed from the lateral side of the car body 2, the lock operating unit 26 and the assist lever unit 27 are hidden by the side carshell 5 and are arranged closer to the specific door opening 5*a* than the turning axis X.

The middle cover 28 is detachably attached to the frame 21 so as to cover a below-described unlocking force transmitting mechanism 31 for unlocking. The lower cover 29 is detachably attached to the frame 21 so as to cover the lock operating unit 26 and the assist lever unit 27. An access hole 29*a* through which the lock operating unit 26 is exposed is formed at the lower cover 29.

A threshold plate 11 is provided at a lower edge of the specific door opening 5*a*. A step mark 12 is provided on the threshold plate 11. The step mark 12 is arranged at the same position as the exterior side step 8 (see FIG. 1) in the car longitudinal direction. The step mark 12 may be arranged adjacent to the threshold plate 11 instead of on the threshold plate 11 as long as the step mark 12 is arranged along the threshold plate 11. The step mark 12 has a color, a pattern, and/or a shape which can be distinguished from surfaces located around the step mark 12. The step mark 12 may be, for example, a tape having a different color from the threshold plate 11.

As shown in FIGS. 4 and 5, the frame 21 includes a first frame portion 21*a* and a second frame portion 21*b* projecting from the first frame portion 21*a* toward the car interior side. The first frame portion 21*a* is attached to the side carshell 5, and the second frame portion 21*b* is connected to the handrail rod 10.

The lock operating unit 26 and the assist lever unit 27 are provided at a lower portion of the first frame portion 21*a* of the frame 21. Specifically, the lock operating unit 26 and the assist lever unit 27 are arranged at positions that are (higher than the floor surface 4*a* of the car body 2 and) lower than the holding portion 23*b*.

The storage lock mechanism 24 and the deployment lock mechanism 25 are provided at the second frame portion 21*b*. The storage lock mechanism 24 is arranged so as to correspond to the engaged portion 23*c* of the holding portion 23*b* of the handle 23 located at the storage position. The deployment lock mechanism 25 is arranged so as to correspond to the engaged portion 23*d* of the base portion 23*a* of the handle 23 located at the deployed position. The handhold device 20 includes the unlocking force transmitting mechanism 31 configured to connect the lock operating unit 26 to the storage lock mechanism 24 and the deployment lock mechanism 25 such that force can be transmitted from the lock operating unit 26 to the storage lock mechanism 24 and the deployment lock mechanism 25. The handhold device 20 includes an assist lever force transmitting mechanism 32 configured to connect the assist lever unit 27 to the handle 23 such that force can be transmitted from the assist lever unit 27 to the handle 23.

When the handle 23 is displaced to the storage position, the storage lock mechanism 24 is engaged with the engaged portion 23*c* of the handle 23. When the handle 23 is displaced to the deployed position, the deployment lock mechanism 25 is engaged with the engaged portion 23*d* of the handle 23. The storage lock mechanism 24 and the deployment lock mechanism 25 include respective latch devices that are the same mechanism as each other. Therefore, hereinafter, the storage lock mechanism 24 will be mainly described. It should be noted that the structures of the storage lock mechanism 24 and the deployment lock mechanism 25 are not limited to the following example, and other lock structures may be used. Further, the storage lock mechanism 24 and the deployment lock mechanism 25 may be different in structure from each other.

Figure 6:
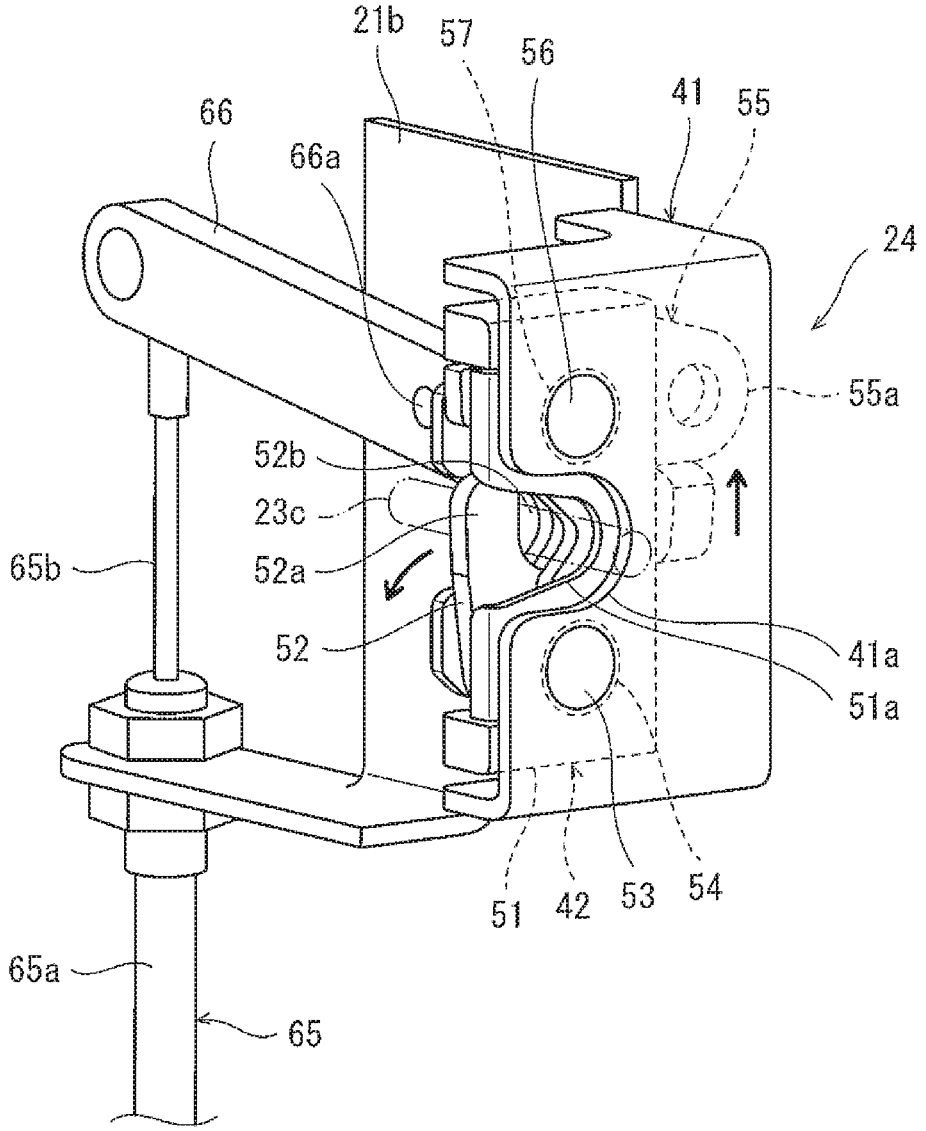
FIG. 6 is a perspective view of a storage lock mechanism of the handhold device of FIG. 4.

FIG. 6 is a perspective view of the storage lock mechanism 24 of the handhold device 20 of FIG. 4. As shown in FIG. 6, the storage lock mechanism 24 includes a casing 41 and a latch device 42. The casing 41 holds the latch device 42 and is fixed to the second frame portion 21*b*. The latch device 42 is exposed from the casing 41 at a side (hereinafter referred to as a handle opposing side) where the casing is opposed to the holding portion 23*b* of the handle 23 located at the storage position. The latch device 42 includes a housing 51, a lock piece 52, a turning shaft 53, a spring 54, an unlocking piece 55, a turning shaft 56, and a spring 57.

The housing 51 includes an internal space that is open toward the handle opposing side. A side wall of the housing 51 includes a groove portion 51*a* that is open toward the handle opposing side. The internal space of the housing 51 accommodates the lock piece 52, the turning shaft 53, the spring 54, the unlocking piece 55, the turning shaft 56, and the spring 57. The lock piece 52 has a U-shape. The lock piece 52 includes a groove-shaped engaging portion 52*a* having an entrance 52*b* that is open toward one side. The lock piece 52 is supported by the housing 51 through the turning shaft 53 so as to be turnable. The lock piece 52 is being biased by the spring 54 so as to become the unlocked state, i.e., so as to make the entrance 52*b* of the engaging portion 52*a* face the handle opposing side.

The unlocking piece 55 is supported by the housing 51 through the turning shaft 56 so as to be turnable. When the engaged portion 23*c* (engaged bar) of the handle 23 is inserted into the groove portion 51*a* of the housing 51, the engaged portion 23*c* pushes and rotates the lock piece 52. With this, the lock piece 52 takes such a position that the entrance 52*b* of the engaging portion 52*a* faces upward. Thus, the lock piece 52 is engaged with the unlocking piece 55 to become the locked state. The unlocking piece 55 is being biased by the spring 57 so as to hold the lock piece 52 in the locked state. In this state, the engaged portion 23*c* of the handle 23 is held by the engaging portion 52*a* of the lock piece 52.

A projecting portion 55*a* of the unlocking piece 55 projects to an outside of the housing 51. When the projecting portion 55*a* of the unlocking piece 55 is pushed upward, and the unlocking piece 55 turns about the turning shaft 56, the lock piece 52 and the unlocking piece 55 are disengaged from each other. The lock piece 52 turns by the biasing force of the spring 54 such that the entrance 52*b* of the engaging portion 52*a* faces the handle opposing side. Thus, the lock piece 52 becomes the unlocked state (see arrows in FIG. 6). In this state, the engaged portion 23*c* of the handle 23 can freely get in or out of the engaging portion 52*a* of the lock piece 52 through the entrance 52*b*.

Figure 7:
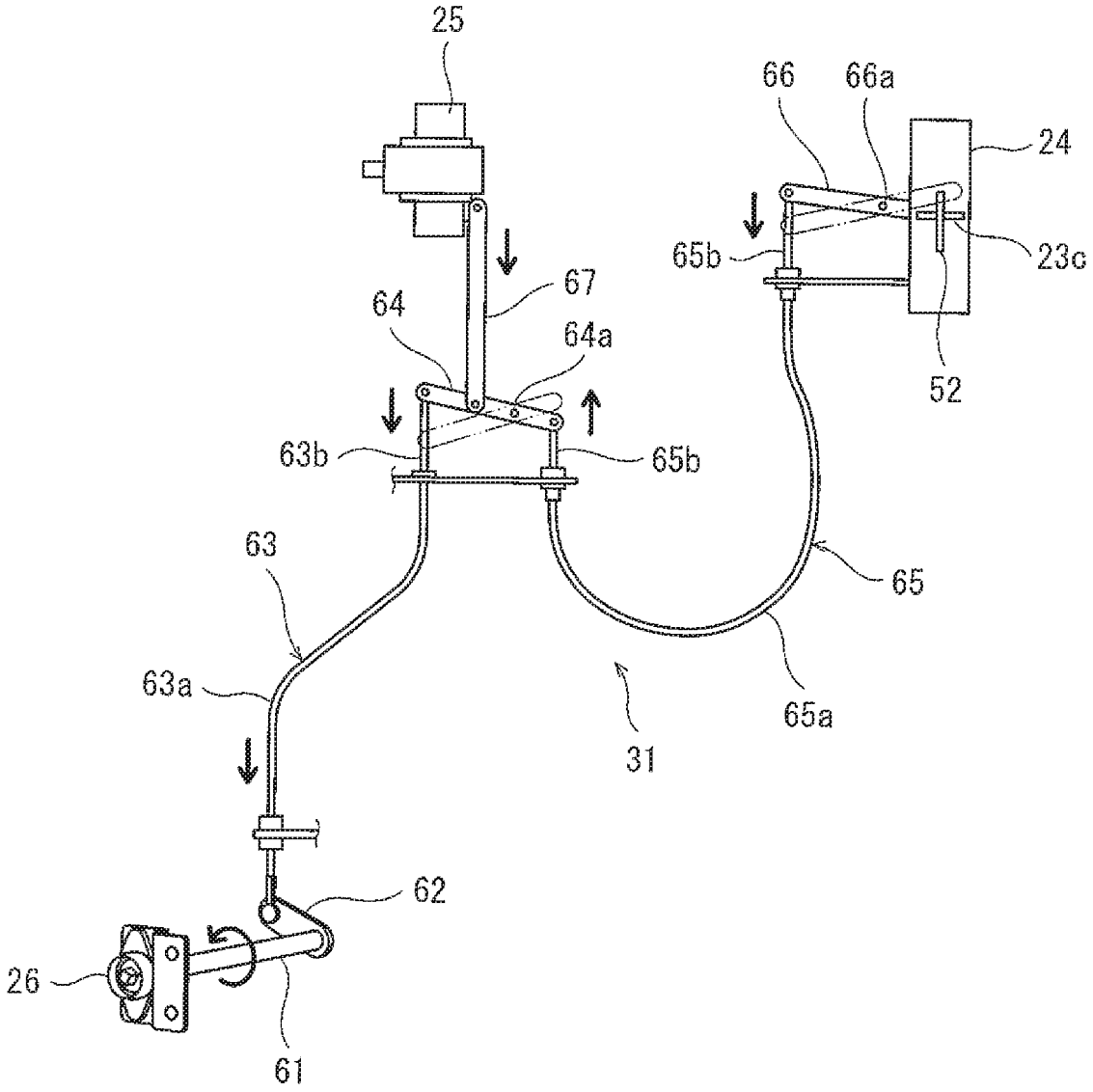
FIG. 7 is a diagram for explaining an unlocking force transmitting mechanism of the handhold device of FIG. 4.

FIG. 7 is a diagram for explaining the unlocking force transmitting mechanism 31 of the handhold device 20 of FIG. 4. As shown in FIG. 7, the unlocking force transmitting mechanism 31 transmits operating force of the lock operating unit 26 to the storage lock mechanism 24 and the deployment lock mechanism 25 as unlocking force. The unlocking force transmitting mechanism 31 includes a rotating shaft 61, a first swing lever 62, a first link cable 63, a second swing lever 64, a second link cable 65, a third swing lever 66, and a link bar 67. The rotating shaft 61 rotates in conjunction with the operation of the lock operating unit 26. The first swing lever 62 swings downward in accordance with the rotation of the rotating shaft 61.

The first link cable 63 and the second link cable 65 are, for example, push-pull cables. The first link cable 63 includes a wire housing 63*a* and a link wire 63*b*. The wire housing 63*a* is fixed to the second frame portion 21*b*, and the link wire 63*b* is inserted into the wire housing 63*a* so as to be displaceable relative to the wire housing 63*a*. The second link cable 65 includes a wire housing 65*a* and a link wire 65*b*. The wire housing 65*a* is fixed to the second frame portion 21*b*, and the link wire 65*b* is inserted into the wire housing 65*a* so as to be displaceable relative to the wire housing 65*a*. A first end of the link wire 63*b* is coupled to the first swing lever 62, and a second end of the link wire 63*b* is coupled to a first end portion of the second swing lever 64. The second swing lever 64 swings in a seesaw manner by a spindle 64*a* serving as a fulcrum. The second link cable 65 is coupled to a second end portion of the second swing lever 64.

A first end of the link wire 65*b* is coupled to the second end portion of the second swing lever 64. A second end of the link wire 65*b* is coupled to a first end portion of the third swing lever 66. The third swing lever 66 swings in a seesaw manner by a spindle 66*a* serving as a fulcrum. A second end portion of the third swing lever 66 is arranged right under the projecting portion 55*a* of the unlocking piece 55 of the storage lock mechanism 24 (see FIG. 6). A first end portion of the link bar 67 is coupled to the second swing lever 64 so as to be turnable. A second end portion of the link bar 67 is coupled to (the unlocking piece 55 of) the deployment lock mechanism 25.

When the worker standing on the ground inserts the key into the lock operating unit 26 through the access hole 29*a* (see FIG. 3) of the lower cover 29 and rotates the lock operating unit 26, the rotating shaft 61 rotates, and therefore, the first swing lever 62 swings. In conjunction with this, the second swing lever 64 swings such that the first end portion of the second swing lever 64 is pulled downward through the first link cable 63, and the second end portion of the second swing lever 64 is displaced upward. In conjunction with this, the third swing lever 66 swings such that the first end portion of the third swing lever 66 is pulled downward through the link wire 65*b*, and the second end portion of the third swing lever 66 is displaced upward.

In conjunction with this, the second end portion of the third swing lever 66 pushes up the projecting portion 55*a* of the unlocking piece 55. Thus, the storage lock mechanism 24 is switched from the locked state to the unlocked state. Simultaneously, the link bar 67 is pulled downward by the swinging of the second swing lever 64. Thus, the deployment lock mechanism 25 is also switched from the locked state to the unlocked state. As above, both the storage lock mechanism 24 and the deployment lock mechanism 25 are unlocked in conjunction with the operation of the lock operating unit 26. It should be noted that the configuration of the unlocking force transmitting mechanism 31 is not limited to the above, and that other force transmitting structures may be used.

Figure 8:
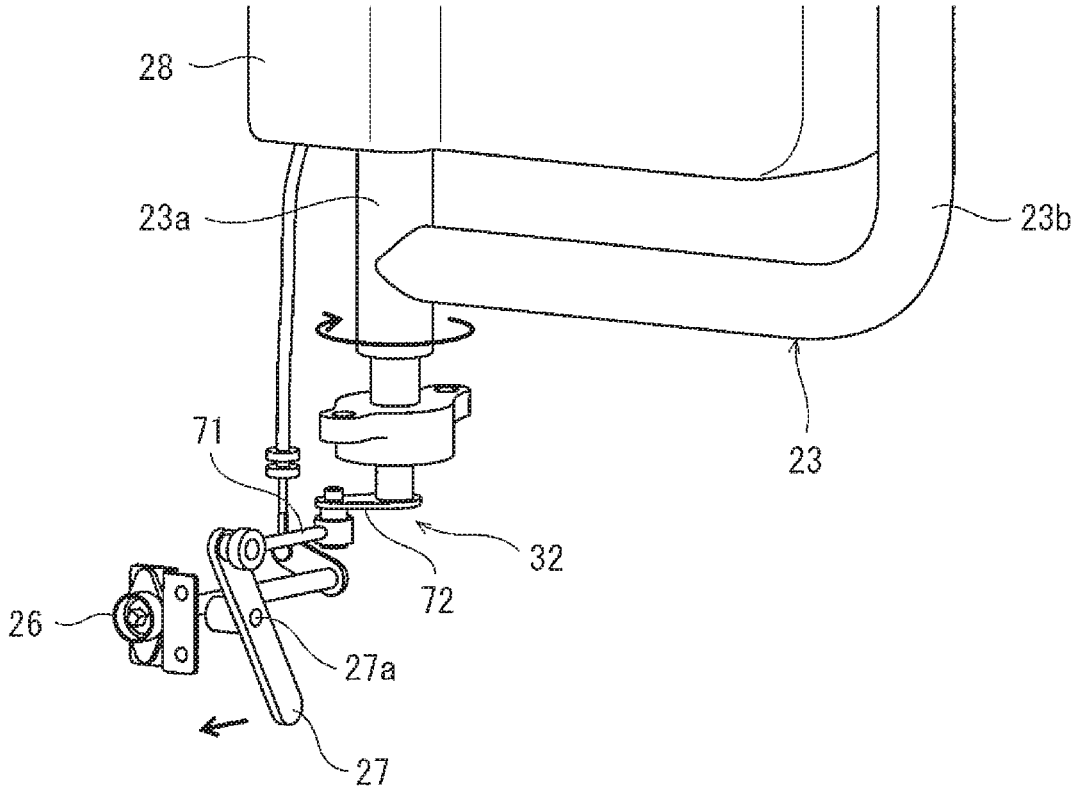
FIG. 8 is a diagram for explaining a assist lever force transmitting mechanism of the handhold device of FIG. 4.

FIG. 8 is a diagram for explaining the assist lever force transmitting mechanism 32 of the handhold device 20 of FIG. 4. As shown in FIG. 8, the assist lever force transmitting mechanism 32 transmits the operating force of the assist lever unit 27 to the handle 23 as handle turning force. The assist lever unit 27 is an operating bar configured to swing in a seesaw manner by a spindle 27*a* serving as a fulcrum. A lower end portion of the assist lever unit 27 is a portion operated by the worker with his/her hands. The assist lever force transmitting mechanism 32 includes a link rod 71 and a swing lever 72. A first end portion of the link rod 71 is coupled to an upper end portion of the assist lever unit 27. A second end portion of the link rod 71 is coupled to a first end portion of the swing lever 72. A second end portion of the swing lever 72 is fixed to a lower end of the base portion 23*a* of the handle 23.

When the worker standing on the ground touches the lower end portion of the assist lever unit 27 with his/her hands and swings the assist lever unit 27, the motion of the assist lever unit 27 is transmitted to the swing lever 72 through the link rod 71, and the swing lever 72 swings about a fulcrum that is a fixed point where the swing lever 72 is fixed to the handle 23. Then, the swinging of the swing lever 72 is converted into the turn of the handle 23 about the turning axis X. To be specific, by operating the assist lever unit 27, the handle 23 can be angularly displaced between the storage position and the deployed position.

According to the above configuration, at the time of maintenance, the handle 23 is angularly displaced to the deployed position. With this, the worker standing on the ground can easily hold the holding portion 23*b* of the handle 23 with his/her hands and stably go up or down the exterior side step 8. After the maintenance is completed, the handle 23 is angularly displaced to the storage position. With this, the handle 23 can be prevented from interfering with the passengers who get in or out of the railcar 1 through the specific door opening 5*a*.

By positioning the handle 23 at the deployed position, stability of the worker who holds the holding portion of the handle 23 and goes up or down the exterior side step 8 improves. Further, by positioning the handle 23 at the storage position, the handle 23 can be stably prevented from interfering with the passengers who get in or out of the railcar 1.

Further, in conjunction with the operation of the lock operating unit 26 operated by the worker, the storage lock mechanism 24 and the deployment lock mechanism 25 are switched from the locked state to the unlocked state. Therefore, the worker can unlock the storage lock mechanism 24 and the deployment lock mechanism 25 by operating the lock operating unit 26 without touching the lock mechanisms 24 and 25. Since the lock operating unit 26 is provided at the lower portion of the frame 21 and located close to the floor surface 4*a* of the car body 2, the worker standing on the ground can easily access the lock operating unit 26.

Further, when viewed from the lateral side of the car body 2, the lock operating unit 26 is hidden by the side carshell 5 and is arranged closer to the specific door opening 5*a* than the turning axis X. Therefore, the lock operating unit 26 does not interfere with the passengers who get in or out of the railcar 1, and the worker standing on the ground can easily access the lock operating unit 26.

Since the storage lock mechanism 24 and the deployment lock mechanism 25 are independent from each other, the storage lock mechanism 24 and the deployment lock mechanism 25 can be optimally designed in accordance with individual design requirements. In this case, since both the storage lock mechanism 24 and the deployment lock mechanism 25 operate in conjunction with the operation of the lock operating unit 26, both the storage lock mechanism 24 and the deployment lock mechanism 25 can be unlocked by one lock operating unit 26. Thus, space efficiency and convenience improve.

The handle 23 is angularly displaced from the storage position to the deployed position in conjunction with the operation of the assist lever unit 27 operated by the worker. Therefore, the worker can change the position of the handle 23 by operating the assist lever unit 27 without touching the handle 23. Since the assist lever unit 27 is provided at the lower portion of the frame 21 and located close to the floor surface 4*a* of the car body 2, the worker standing on the ground can easily access the assist lever unit 27.

Further, since the assist lever unit 27 is hidden by the side carshell 5 and located closer to the specific door opening 5*a* than the turning axis X when viewed from the lateral side of the car body 2, the assist lever unit 27 does not interfere with the passengers who get in or out of the railcar 1, and the worker standing on the ground can easily access the assist lever unit 27.

The storage lock mechanism 24 is explained as one example of the storage positioner, and the deployment lock mechanism 25 is explained as one example of the deployment positioner. However, mechanisms other than the lock mechanisms described herein may be used. For example, the storage positioner (or the deployment positioner) may be a spring mechanism configured to bias the handle 23 toward the storage position (or the deployed position), etc.

Figure 9A:
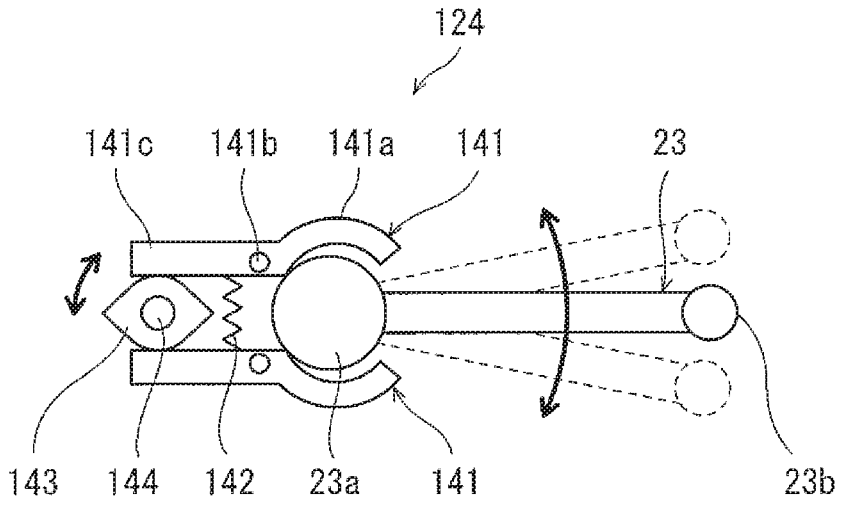
FIG. 9A is a plan view of an unlocked state of a lock mechanism of an exemplary embodiment.
Figure 9B:
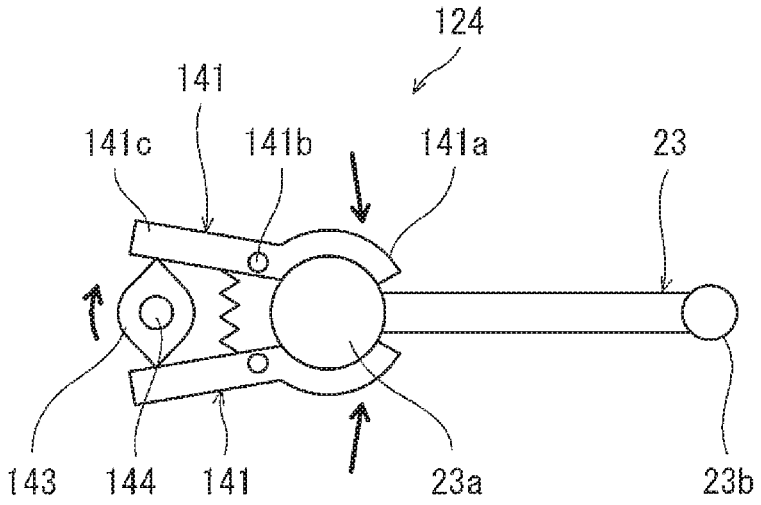
FIG. 9B is a plan view of a locked state of the lock mechanism of FIG. 9A.

FIG. 9A is a plan view of the unlocked state of a lock mechanism 124 of an exemplary embodiment. FIG. 9B is a plan view of the locked state of the lock mechanism 124 of FIG. 9A. The lock mechanism 124 includes a pair of clamps 141, a spring 142, a cam 143, and a camshaft 144. Each clamp 141 includes a pressing portion 141*a*, a fulcrum portion 141*b*, and a force point portion 141*c*. The pressing portion 141*a* and the force point portion 141*c* are arranged at both sides of the fulcrum portion 141*b*. The pressing portion 141*a* has such a shape as to be able to press the base portion 23*a* of the handle 23. Force of making the clamp 141 swing about the fulcrum portion 141*b* is input to the force point portion 141*c*.

The spring 142 configured to bias the force point portions 141*c* of the pair of clamps 141 such that the force point portions 141*c* get close to each other is provided at the force point portions 141*c* of the pair of clamps 141. The cam 143 provided at the camshaft 144 is interposed between the force point portions 141*c* of the pair of clamps 141. The camshaft 144 is configured to rotate in conjunction with the rotation of the lock operating unit 26 (see FIG. 7). When the cam 143 rotates, the pair of force point portions 141*c* move away from each other, and the pair of pressing portions 141*a* move close to each other.

With this, the base portion 23*a* of the handle 23 is pinched between the pair of pressing portions 141*a*, and thus, the handle 23 is locked. To be specific, the handle 23 can be locked by the lock mechanism 124 at any angle. In other words, the handle 23 can be locked at each of the storage position and the deployed position by one lock mechanism 124.

Figure 10:
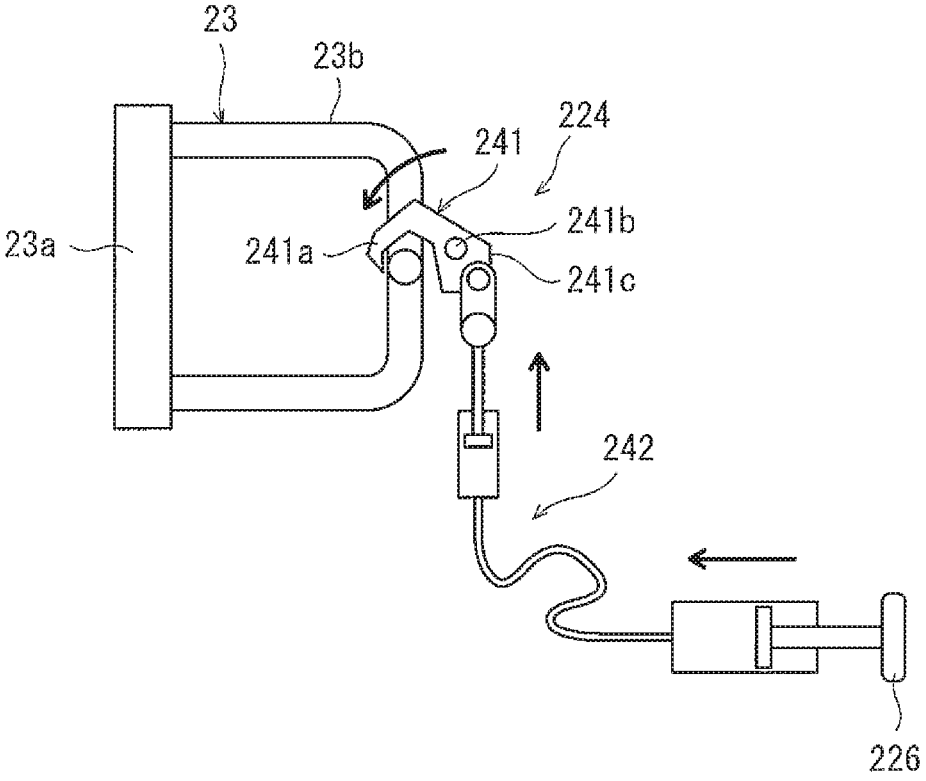
FIG. 10 is a side view of the lock mechanism of an exemplary embodiment.

FIG. 10 is a side view of a lock mechanism 224 of an exemplary embodiment. As shown in FIG. 10, the lock mechanism 224 includes a lock piece 241 and a pneumatic mechanism 242. The lock piece 241 includes an engaging portion 241*a*, a fulcrum portion 241*b*, and a force point portion 241*c*. The engaging portion 241*a* and the force point portion 241*c* are arranged at both sides of the fulcrum portion 241*b*. The engaging portion 241*a* has such a shape as to be able to be engaged with the engaged portion 23*c* of the handle 23. Force of making the lock piece 241 swing about the fulcrum portion 241*b* is input to the force point portion 241*c*.

A lock operating unit 226 and the force point portion 241*c* are pneumatically connected to each other by the pneumatic mechanism 242 serving as the force transmitting mechanism. The pneumatic mechanism 242 includes, for example, a pneumatic cylinder and a pneumatic pipe. When the worker operates the lock operating unit 226 in one direction, the force is input to the force point portion 241*c* through the pneumatic mechanism 242. With this, the lock piece 241 swings, and the engaging portion 241*a* is engaged with the engaged portion 23*c* of the handle 23. Thus, the locked state is realized. When the worker operates the lock operating unit 226 in an opposite direction, force acting in an opposite direction is input to the force point portion 241*c* through the pneumatic mechanism 242. With this, the lock piece 241 swings, and the engaging portion 241*a* is disengaged from the engaged portion 23*c* of the handle 23. Thus, the unlocked state is realized.

Figure 11:
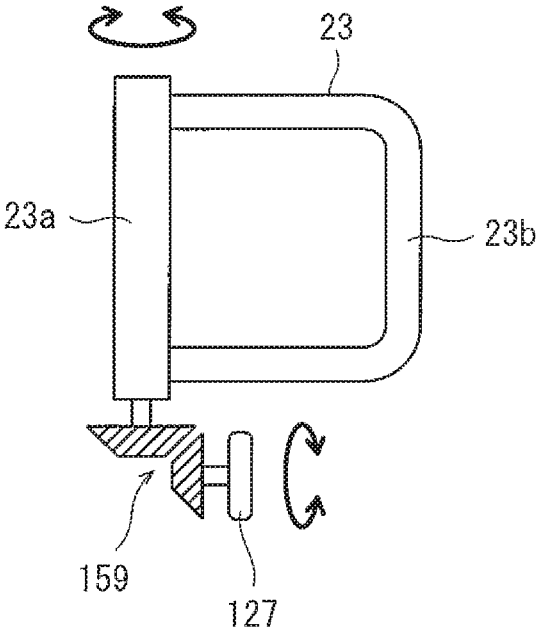
FIG. 11 is a side view of an assist lever unit of an exemplary embodiment.

FIG. 11 is a side view of an assist lever unit 127 of an exemplary embodiment. As shown in FIG. 11, the assist lever unit 127 is rotated by the worker. The assist lever unit 127 is connected to the base portion 23*a* of the handle 23 through a bevel gear 159 serving as the assist lever force transmitting mechanism. Rotation operating force applied from the hands of the worker to the assist lever unit 127 is transmitted to the base portion 23*a* of the handle 23 through the bevel gear 159 as turning force. Thus, the handle 23 turns.

From the foregoing explanation, many modifications and other embodiments of the present invention are obvious to one skilled in the art. Therefore, the foregoing explanation should be interpreted only as an example and is provided for the purpose of teaching the best mode for carrying out the present invention to one skilled in the art. The structures and/or functional details may be substantially modified within the scope of the present invention.

What is claimed is:

1. A handhold of a railcar, the handhold corresponding to a specific door opening located above a exterior side step projecting downward from a side carshell of a car body of the railcar among door openings of the side carshell, the handhold being arranged in the railcar and attached to the side carshell, the handhold comprising:
- a frame arranged along a side edge of the specific door opening and connected to a car interior side of the side carshell;
- a turner provided at the frame and configured to be turnable about a turning axis extending in an upper-lower direction; and
- a handle including
  - a base structure connected to the frame through the turner and
  - a holding structure projecting from the base structure in a direction intersecting with the turning axis, wherein
- the handle is angularly displaceable about the turning axis between a deployed position where the holding structure is exposed to the specific door opening when viewed from a lateral side of the car body and a storage position where the holding structure is hidden by the side carshell when viewed from the lateral side of the car body.

2. The handhold according to claim 1, further comprising a positioner configured to position the handle at at least one of the deployed position and the storage position.

3. The handhold according to claim 2, further comprising a lock operator to be operated by a worker, wherein:
- the positioner includes a lock configured to hold the handle at at least one of the deployed position and the storage position; and
- the lock is switched from a locked state to an unlocked state in conjunction with operation of the lock operator.

4. The handhold according to claim 3, wherein the lock operator is provided at a lower portion of the frame.

5. The handhold according to claim 3, wherein the lock includes a deployment lock and a storage lock that is independent from the deployment lock.

6. The handhold according to claim 5, wherein both the deployment lock and the storage lock operate in conjunction with the operation of the lock operator.

7. The handhold according to claim 1, further comprising a handle operator configured to be operated by a worker, wherein
- the handle is angularly displaced from the storage position to the deployed position in conjunction with operation of the handle operator.

8. The handhold according to claim 7, wherein the handle operator is provided at a lower portion of the frame.

9. A railcar comprising:
- a car body including a side carshell having door openings;
- a exterior side step corresponding to a specific door opening among the door openings, the exterior side step being located under the specific door opening and projecting downward from the side carshell; and a handhold arranged in the car body and attached to the side carshell, wherein:

the handhold includes a frame arranged along a side edge of the specific door opening and connected to the side carshell, a turner connected to the frame and configured to be turnable about a turning axis extending in an upper-lower direction, and a handle including a base structure and a holding structure, the base structure being connected to the frame through the turner, the holding structure projecting from the base structure in a direction intersecting with the turning axis; and the handle is angularly displaceable about the turning axis between a deployed position where the holding structure is exposed to the specific door opening when viewed from a lateral side of the car body and a storage position where the holding structure is hidden by the side carshell when viewed from the lateral side of the car body.

10. The railcar according to claim 9, further comprising:

a lock configured to hold the handle at at least one of the deployed position and the storage position; and a lock operator provided at a lower portion of the frame and to be operated by a worker, wherein the lock is switched from a locked state to an unlocked state in conjunction with operation of the lock operator.

11. The railcar according to claim 10, further comprising a passenger seat arranged close to the specific door opening in the railcar, wherein the lock operator is arranged at a position higher than a floor surface of the car body and lower than a seat surface of the passenger seat.

12. The railcar according to claim 10, wherein the lock operator is arranged at a position higher than a floor surface of the car body and lower than the holding structure.

13. The railcar according to claim 10, wherein the lock operator is arranged in a height range of 0 to 30 cm from a floor surface of the car body.

14. The railcar according to claim 10, wherein when viewed from the lateral side of the car body, the lock operator is hidden by the side carshell and arranged closer to the specific door opening than the turning axis.

15. The railcar according to claim 9, further comprising a handle operator provided at a lower portion of the frame and operated by a worker, wherein the handle is angularly displaced from the storage position to the deployed position in conjunction with operation of the handle operator.

16. The railcar according to claim 15, further comprising a passenger seat arranged close to the specific door opening in the railcar, wherein the handle operator is arranged at a position higher than a floor surface of the car body and lower than a seat surface of the passenger seat.

17. The railcar according to claim 15, wherein the handle operator is arranged at a position higher than a floor surface of the car body and lower than the holding structure.

18. The railcar according to claim 15, wherein the handle operator is arranged in a height range of 0 to 30 cm from a floor surface of the car body.

19. The railcar according to claim 15, wherein when viewed from the lateral side of the car body, the handle operator is hidden by the side carshell and arranged closer to the specific door opening than the turning axis.

20. A handhold of a railcar, the handhold corresponding to a specific door opening located above a exterior side step projecting downward from a side carshell of a car body of the railcar among door openings of the side carshell, the handhold being arranged in the railcar and attached to the side carshell, the handhold comprising:

a frame arranged along a side edge of the specific door opening and connected to a car interior side of the side carshell;

means for turning provided at the frame and configured to be turnable about a turning axis extending in an upper-lower direction; and a handle including a base structure connected to the frame through the means for turning and means for holding projecting from the base structure in a direction intersecting with the turning axis, wherein the handle is angularly displaceable about the turning axis between a deployed position where the means for holding is exposed to the specific door opening when viewed from a lateral side of the car body and a storage position where the means for holding is hidden by the side carshell when viewed from the lateral side of the car body.

* * * * *